United States Patent [19]

MacDonald et al.

[11] 4,163,474

[45] Aug. 7, 1979

[54] INTERNALLY FINNED TUBE

[75] Inventors: Robert D. MacDonald, Phoenix, Ariz.; Robert K. Rose, Burnt Hills, N.Y.; John W. Papsdorf, Lake Orion, Mich.

[73] Assignee: E. I. Du Pont de Nemours and Company, Wilmington, Del.

[21] Appl. No.: 805,063

[22] Filed: Jun. 9, 1977

Related U.S. Application Data

[63] Continuation-in-part of Ser. No. 665,465, Mar. 10, 1976, abandoned.

[51] Int. Cl.[2] ..... F28F 1/40

[52] U.S. Cl. ..... 165/179; 138/38; 29/157.3 R; 138/112

[58] Field of Search ..... 29/157.3 A; 165/166, 165/154, 183; 138/38, 39, 156, 162

[56] References Cited

U.S. PATENT DOCUMENTS

| | | | |
|---|---|---|---|
| 2,032,134 | 2/1936 | Larkin | 138/38 |
| 2,079,144 | 5/1937 | Abba | 138/38 |
| 3,200,848 | 8/1965 | Takagi | 165/183 X |
| 3,208,131 | 9/1965 | Ruff et al. | 29/157.3 A |
| 3,359,616 | 12/1967 | Butt | 29/157.3 A |
| 3,426,176 | 2/1969 | Simon | 165/166 X |
| 3,473,348 | 10/1969 | Bottum | 165/154 |
| 3,477,499 | 11/1969 | Goetz | 62/499 |

FOREIGN PATENT DOCUMENTS

| | | | |
|---|---|---|---|
| 995294 | 8/1951 | France | 165/179 |

*Primary Examiner*—Samuel Scott
*Assistant Examiner*—Theophil W. Streule, Jr.
*Attorney, Agent, or Firm*—Cullen, Sloman, Cantor, Grauer, Scott and Rutherford

[57] ABSTRACT

Fluid-carrying tubes for a heat exchanger are provided with internal longitudinal fins formed separately from the tube itself. One form utilizes individual elongated V-shaped strips biased radially outwardly by an annular sheet metal spring, with the tips of the fins brazed to the inner surface of the tube wall. Second and third embodiments utilize a one-piece corrugated sheet metal cylinder rather than individual strips, but with adjacent fins being almost completely severed from each other to provide sharp edge contact between the tips of the fins and the tube wall for optimum brazing. Either the fins or tube inner wall is clad with a lower-melting point material which permits furnace brazing of the fin tips to the tube wall. All three forms have longitudinally spaced holes and slots to enhance heat exchange by inducing transverse fluid flow through the fins and to allow liquid levels to equalize.

6 Claims, 8 Drawing Figures

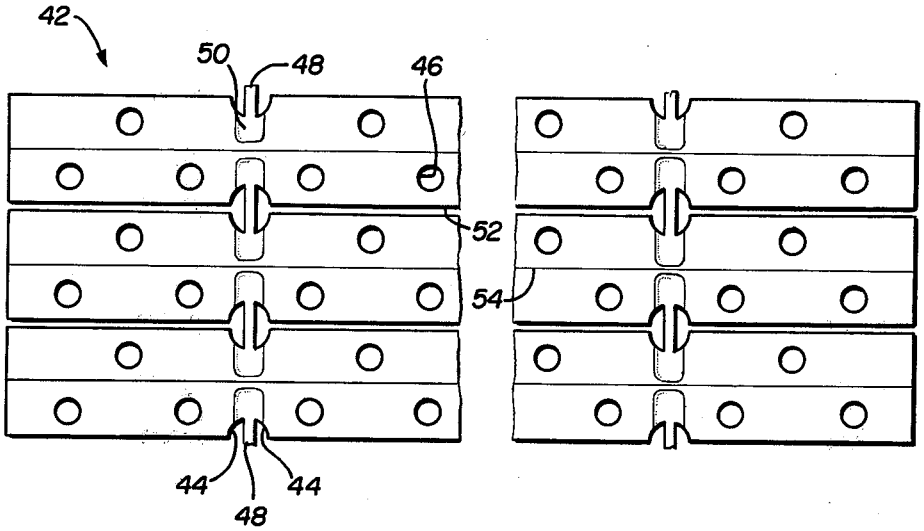
FIG. 6
FIG. 7
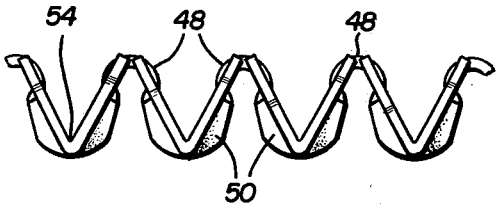
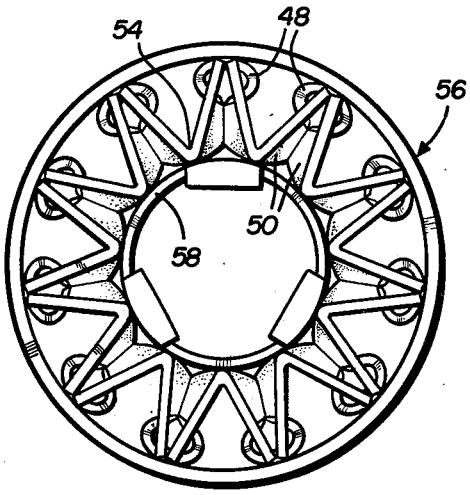
FIG. 8

INTERNALLY FINNED TUBE

This application is a continuation-in-part of application Ser. No. 665,465 filed Mar. 10, 1976, now abandoned.

BACKGROUND OF INVENTION

This invention relates to an improved heat exchanger construction which provides increased heat transfer in either direction between the fluid within a tube and the outer surface of the tube. The particular type of heat exchanger disclosed herein comprises a plurality of parallel fluid-carrying tubes arranged in cylindrical fashion, the tubes having a series of thin sheet metal annular fins closely spaced along their length to enhance the heat exchanging efficiency. Each fin is provided with punched holes to receive an array of tubes. This type of heat exchanger may be mounted for rotation about the axis of the fins, with the rotation establishing an axial air flow into the center of the array and then radially outwardly over the surface of the tubes and fins. Examples of this type of heat exchanger may be found in U.S. Pat. Nos. 3,189,262 and 3,347,059. The same shaped annular fin construction is shown in U.S. Pat. No. 4,005,748.

The invention disclosed herein is directed to an improvement in heat exchange efficiency provided by internal fins within each of the heat exchanger tubes. The prior art has employed a variety of techniques for constructing an internally-finned tube. Prior art of which Applicants are aware is exemplified by U.S. Pat. Nos. 349,060; 2,032,134; 2,079,144; 2,445,471; 3,005,036; 3,200,848; 3,208,131; 3,359,616; 3,473,348; and 3,773,106. However, Applicants have encountered substantial problems in attempting to design and construct an efficient internally finned tube which can be economically manufactured and which assures proper heat transfer between the internal fins and the tube wall.

Such a tube should have minimum wall and fin thickness, to reduce the weight and cost of material and to facilitate heat transfer. There must be a firm and solid connection between the fins and the inner surface of the tube wall, so that heat will flow across such joint without any insulating gaps. Such a tube must also be compatible with high production techniques, with a minimum of handling and labor required for its fabrication.

Accordingly, it is the principal object of this invention to provide an internally finned tube for a heat exchanger which satisfies all of the above criteria.

PRIOR RELATED APPLICATION

This application is a continuation in part of co-pending application Ser. No. 665,465 filed Mar. 10, 1976 by Robert D. MacDonald and Robert K. Rose, entitled "Internally Finned Tube".

BRIEF DESCRIPTION OF THE DRAWINGS

FIG. 6 is a fragmentary plan view of a sheet metal panel from which a third embodiment of the internally-finned tube can be fabricated.

FIG. 7 is an end view of the panel of FIG. 6, after corrugating but prior to rolling into a cylinder.

FIG. 8 is an end view similar to FIG. 2 but showing the third embodiment of FIGS. 6–7 after assembly.

DETAILED DESCRIPTION OF THE INVENTION

Figure 1:
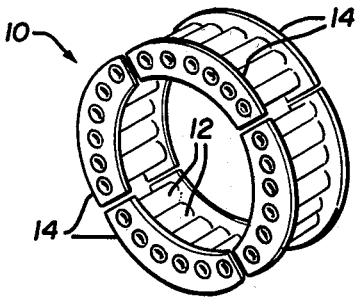
FIG. 1 is a perspective view of a portion of a heat exchanger employing the internally-finned tubes of this invention.

Referring to FIG. 1, there is illustrated a portion of a heat exchanger 10 comprising a plurality of parallel fluid-carrying tubes 12 which pass through holes in annular external fin segments 14. Such a heat exchanger is adapted to rotate about an axis corresponding with the center of the annulus, and in actual practice, the heat exchanger would be elongated in the direction of the tubes, with the tubes carrying many closely packed external fin segments 14. However, it is to be understood that the internal fins disclosed herein may be advantageously employed in a wide variety of heat exchanger applications, the heat exchanger illustrated in FIG. 1 being merely exemplary.

Figure 2:
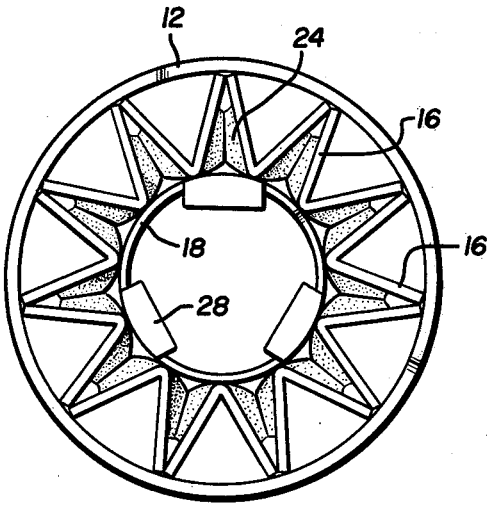
FIG. 2 is an enlarged end view of one of the heat exchanger tubes.
Figure 3:
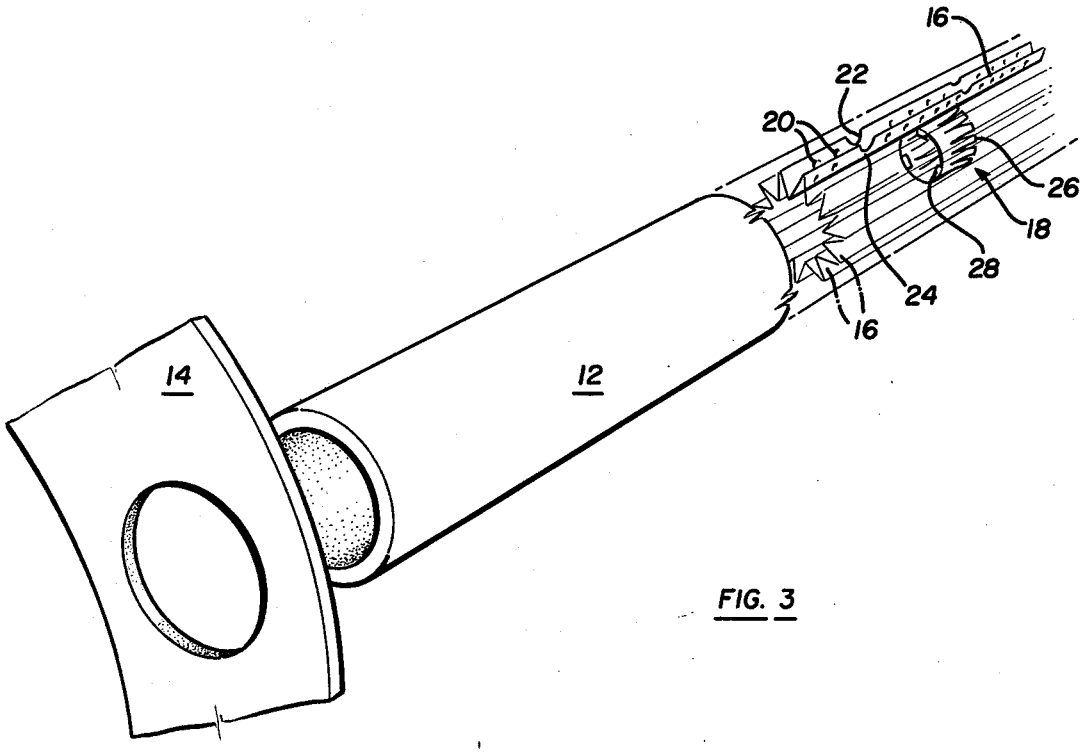
FIG. 3 is an exploded perspective view of a portion of the heat exchanger of FIGS. 1 and 2.

As best shown in FIGS. 2 and 3, each tube 12 is provided with a series of longitudinally extending internal fins 16, which are resiliently urged radially outwardly into contact with the inner surface of the tube wall by means of an annular sheet metal spring 18. The fins are in the form of a series of elongated V-shaped strips, with the two legs of each strip being oriented so as to extend generally radially away from the axis of the tube, with the outer edges of each strip being in contact with the inner surface of the tube wall.

As shown in FIG. 3, each of the fins 16 is provided with longitudinally spaced holes 20. The purpose of these holes is to induce transverse flow of fluid through each fin as the fluid also travels longitudinally along the tube, such flow being intended to create a scrubbing action to wipe away the boundary layer and thereby enhance effective heat transfer between the fin and fluid. Such scrubbing action may be enhanced by staggering the longitudinal position of the holes on one fin relative to the holes on each adjacent fin.

Particularly in applications where the tube is carrying a mixture of liquid and vapor, it is desirable to equalize the distribution of liquid around the periphery of the tube, to avoid the build-up of excessive liquid which would interfere with maximum heat transmission and unbalance the rotating heat exchanger. Liquid accumulation is particularly undesirable in the evaporator, where oil mixed with the refrigerant tends to collect against the cold surfaces. For this purpose, it may be useful to employ a series of longitudinally spaced notches 22 at the outer edge of each fin, so that liquid can flow transversely or circumferentially along the tube wall, even prior to its accumulation to a depth sufficient to pass through holes 20.

Assembly of the construction of FIGS. 2 and 3 may be accomplished by arranging the tube vertically, with a mandrel located concentrically within the tube. This technique would permit each individual fin to be dropped into the annular space remaining between the mandrel and the inner surface of the tube, the mandrel functioning to maintain the fin strips 16 in the desired position until all of them have been inserted. To further aid in this pre-positioning, the strips may be provided with longitudianlly spaced dimple-like formations 24, which, as shown in FIG. 2, limit the degree to which the strips 16 can slip circumferentially during this initial assembly stage.

Once all of the strips have been inserted, spring 18 can be inserted in order to permanently maintain the strips in their desired positions, and to assure that their outer edges will be held in contact with the inner surface of the tube wall. Springs 18 may be formed of sheet metal, having a series of parallel slits 26 at one end and a series of tabs 28 at the other end. The spring is then formed into a cylinder and spot welded to hold it in such form, with the slitted end being resiliently flared outwardly to provide the desired outwardly directed biasing force. Tabs 28 function to provide a surface which can be engaged by a push rod used for pushing the spring axially into the tube. In practice, the series of such springs may be longitudinally spaced along the length of the tube.

To assure maximum continuity and heat flow between the fins 16 and the wall of tube 12, it is desirable that the outer edges of the fins be brazed to the tube wall. This can most effectively be accomplished by cladding either the inside of the tube or the strips, the cladding being a material that melts at a temperature slightly below the melting point of the base materials. Thus, after assembly, the internally finned tube can be placed in a furnace and heated to the melting point of the cladding material, whereupon such material will flow and establish the desired bond at the joint between the outer edge of the fin and the tube wall. It has been observed that the quality of the brazed joint is best when the outer edge of the fin has a sharp corner. Thus, the prior art fin configurations, wherein the outer edges were folded or doubled back to form a continuous undulating fin, did not provide the necessary continuity across the fin-tube wall interface.

Figure 4:
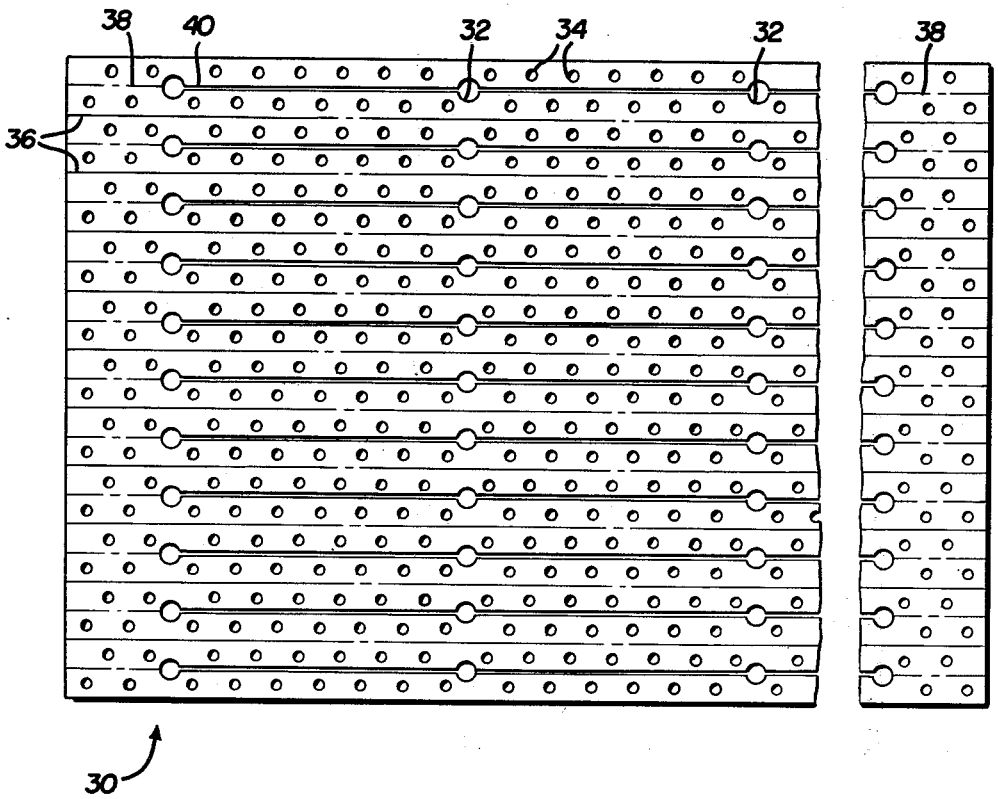
FIG. 4 is a fragmentary plan view of a sheet metal panel from which a second embodiment of the internally-finned tube can be fabricated.
Figure 5:
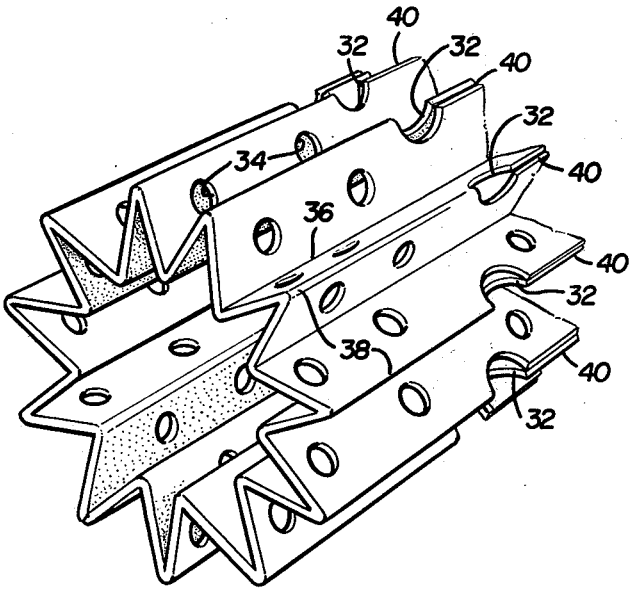
FIG. 5 is a perspective view of the internal fins made from the panel of FIG. 4.

Referring now to the embodiment of FIGS. 4 and 5, there is illustrated a fin construction which eliminates the need to separately handle and assemble the individual fin strips 16 of the embodiment of FIGS. 2 and 3. A single integral sheet metal panel is punched to provide notches 32 and holes 34, corresponding to notches 22 and holes 20 of the embodiment of FIGS. 2 and 3. Parallel base fold lines 36 and end fold lines 38 are shown in phantom in FIG. 4. A series of cut lines 40 aligned with end fold lines 38 represents lines at which panel 30 is completely cut through rather than merely folded. The cut lines 40 form clean cut edges having sharp corners. A crevice area is defined between the sharp corners.

After punching of notches 32, holes 34 and lines 40, panel 30 can be progressively bent and folded into a corrugated shape and then into a corrugated cylindrical shape as shown in FIG. 5. End fold lines 38 preserve the continuity of the cylindrical corrugated tube, while cut lines 40 become the outer ridges of the corrugated cylinder and establish the desired sharp outer edges of the individual fin elements. Base fold lines 38 become the inner ridges of the corrugated cylinder. If desired, additional reinforcement can be provided at longitudinally spaced points by substituting a fold line such as at 38 for a portion of the cut lines 40. Furthermore, a spring may be employed to aid in assuring adequate contact between the outer edges of the fins and the tube wall, as in the embodiment of FIGS. 2 and 3.

Brazing of the fin outer edges to the inside tube wall may be accomplished in the same fashion as in the embodiment of FIGS. 2 and 3.

FIGS. 6–8 illustrate a third embodiment of the present invention, this embodiment being similar to the embodiment of FIGS. 4 and 5 in that the array of fins is formed out of a single integral panel 42. As best shown in FIG. 6, sheet metal panel 42 is punched to provide a series of notches 44 and holes 46, these notches and holes corresponding to and serving the same purpose as the notches and holes of the first and second embodiments. In FIG. 6, however, it will be seen that the notches are arranged in pairs of opposed semi-circular notches spaced apart by a narrow link 48 of metal which interconnects the dimple-shaped formations 50 which correspond to formations 24 in the embodiment of FIGS. 1–3.

A series of parallel slits or cut lines 52 provides substantial but not complete separation of the individual adjacent fins from each other, the fins still being tied together as one integral array by links 48. Fold lines 54 are shown in phantom in FIG. 6, these lines corresponding to the radially inward ridges which will be created after corrugation of the panel.

After punching and slitting of panel 42, the panel is folded into its corrugated shape, as shown in end view of FIG. 7. From FIG. 7 it will be apparent that links 48 maintain the integrity of the fin array as a single unit, while providing substantial yieldability of the array. After corrugating, the array may be wrapped into a hollow cylinder for insertion into tube 56, as shown in FIG. 7. A spring 58, like spring 18 in the embodiment of FIGS. 1–3, may be utilized to aid in properly positioning the array of fins for brazing to the inner surface of the tube wall.

Experience to date suggests that the embodiment of FIGS. 6–8 is the preferred construction for the internal fins. Links 48 function to maintain the array of fins as a single unit, thus simplifying the handling and assembly of the fins within the tube. Yet, links 48 are sufficiently yieldable to permit the fins to properly orient themselves to assure the desired contact between the outer edges of each fin and the inner surface of the tube wall. The links, which may be aided by dimple formations 50, thus prevent the fins from becoming misaligned prior to brazing with resulting loss of fin-tube contact.

The links are also yieldable enough to readily permit expansion of the fin cylinder by spring or resilient ring 58, if such ring is employed.

By way of example, heat exchangers have been fabricated according to the present invention using 0.75" diameter aluminum tubing having 0.020" wall thickness, 0.016" thick aluminum fins and 0.008" thick stainless steel springs. Alternatively, a torsion type coil spring could be employed for urging the fins outwardly into contact with the tube wall.

This invention may be further developed within the scope of the following claims. Accordingly, the above description is to be interpreted as illustrative of only three operative embodiments of this invention, rather than in a strictly limited sense.

We now claim:

1. An internally finned tube for use as part of a heat-exchanging system comprising:

an elongated cylindrical tube;

an array of fins in the form of a hollow integral sheet metal cylinder having V-shaped corrugations, with the corrugation ridges extending parallel to the axis of the tube when said cylinder is inserted in the tube, the outer ridges of said cylinder being in contact with the inner surface of the wall of said tube for substantially the full length of said outer ridges, the cylinder being severed along most but not all of the length of each of said outer ridges, the severence lines severing the outer radial ends of each fin from each other to define narrow clean-cut edges longitudinally extending with sharp corners for contact with the inner surface of the tube wall said sharp edges defining therebetween a crevice area, one of either the cylinder or the inner surface of the tube wall being clad with a material having a melting point lower than that of either the base material of the tube or of the cylinder so that said sharp edges of the fins are brazed to the inner surface of the tube said sharp edges bonded into said cladding material, the unsevered portions maintaining said cylinder as an integral unit for insertion into the tube.

2. The tube of claim 1 wherein each fin is provided with longitudinally spaced openings to permit fluid to flow transversely through each fin from one side of each fin to the other.

3. The tube of claim 1 which further comprises separate resilient means located within said cylinder to bias said fins radially outwardly to maintain contact between said outer ridges and the inner surface of the tube wall.

4. An internally finned tube for use as part of a heat-exchanging system comprising:

an elongated cylindrical tube;

an array of fins in the form of a hollow integral sheet metal cylinder having V-shaped corrugations, with the corrugation ridges extending parallel to the axis of the tube when said cylinder is inserted in the tube, the outer ridges of said cylinder being in contact with the inner surface of the wall of said tube for substantially the full length of said outer ridges, each of said outer ridges being notched at a plurality of spaced locations along their length, each notch being formed by the removal of metal at said ridge and for a predetermined depth therefrom toward each adjacent inner ridge, said notches being arranged in relatively widely spaced pairs, each notch pair comprising two very closely spaced notches which define therebetween a very narrow readily yieldable connecting link of metal bridging the gap between the notches of said pair and across the outer ridge, said outer ridges between said notched pairs being slit in a longitudinal direction to completely sever the two sides of each ridge from each other except for said connecting links, such severence leaving a clean-cut edge on the outer radial end of each fin for engaging it with the inner surface of the tube wall, one of either the cylinder or the inner surface of the tube wall being clad with a material having a melting point lower than that of either the base material of the tube or of the cylinder so that said sharp edges of the fins may be brazed to the inner surface of the tube, said fins being so disposed within the tube that fluid flowing from the tube may be in contact with both faces of each fin as well as with the inner surface of the tube wall.

5. The tube of claim 4 wherein each fin is provided with longitudinally spaced openings to permit fluid to flow transversely through each fin from one side of each fin to the other.

6. The tube of claim 4 which further comprises separate resilient means located within said cylinder to bias said fins radially outwardly to maintain contact between said outer ridges and the inner surface of the tube wall.

* * * * *